US005697734A

United States Patent [19]

Verstraeten

[11] Patent Number: 5,697,734

[45] Date of Patent: Dec. 16, 1997

[54] METHOD FOR FORMING A FOUNDATION PILE IN THE GROUND UTILIZING A PREFABRICATED PILE SHAFT

[75] Inventor: Alexander Julien Verstraeten, Knokke-Heist, Belgium

[73] Assignee: Beheersmaatschappij Verstraeten B.V., Netherlands

[21] Appl. No.: 571,871

[22] PCT Filed: Jul. 4, 1994

[86] PCT No.: PCT/NL94/00154

§ 371 Date: Jan. 4, 1996

§ 102(e) Date: Jan. 4, 1996

[87] PCT Pub. No.: WO95/02092

PCT Pub. Date: Jan. 19, 1995

[30] Foreign Application Priority Data

Jul. 5, 1993 [NL] Netherlands ..... 9301176

[51] Int. Cl.[6] ..... E02D 5/34

[52] U.S. Cl. ..... 405/243; 405/232; 405/240; 405/242

[58] Field of Search ..... 405/231–243

[56] References Cited

U.S. PATENT DOCUMENTS

| | | | |
|---|---|---|---|
| 2,421,666 | 6/1947 | Upson et al. | 405/243 X |
| 3,198,857 | 8/1965 | Childers et al. | 405/243 X |
| 3,336,760 | 8/1967 | Landau . | |
| 3,453,832 | 7/1969 | Rehmar | 405/241 |
| 4,100,750 | 7/1978 | Labrue | 405/241 |
| 4,623,025 | 11/1986 | Verstraeten | 405/242 X |

FOREIGN PATENT DOCUMENTS

| | | | |
|---|---|---|---|
| C-407615 | 12/1924 | Germany . | |
| C-417328 | 8/1925 | Germany . | |
| A-2120691 | 11/1972 | Germany . | |
| A-3501439 | 10/1984 | Germany . | |
| 0085021 | 7/1981 | Japan | 405/243 |
| 0178027 | 11/1982 | Japan | 405/243 |
| 862703 | 3/1961 | United Kingdom | 405/243 |

*Primary Examiner*—Dennis L. Taylor
*Attorney, Agent, or Firm*—Kenyon & Kenyon

[57] ABSTRACT

A method for forming a foundation pile in the ground utilizing a prefabricated pile shaft, placed with clearance into a tube screwed into the bearing ground layer, which tube is provided with a screw blade. Between the wall of the tube and the pile shaft a self-hardening mass is provided. The tube can be removed from the ground in the unscrewing direction while operating as a screw conveyor. The tube may also be retracted from the ground, initially without rotation, with a thick skin of self-hardening mass being formed around the pile shaft, which mass is subsequently pressurized by causing the tube to function as a screw conveyor.

4 Claims, 7 Drawing Sheets

METHOD FOR FORMING A FOUNDATION PILE IN THE GROUND UTILIZING A PREFABRICATED PILE SHAFT

The invention relates to a method for forming a foundation pile in the ground utilizing a prefabricated pile shaft, in which, successively a.—a hollow tube, closed at the lower end by means of a pile base, is driven into the ground until the end of the tube extends into a bearing ground layer over a desired distance;

b.—a prefabricated pile shaft is placed into the hollow tube, resting on the pile base and leaving clear an annular space between the walls of the tube and the pile shaft;

c.—the annular space is filled with a self-hardening mass;

d.—the hollow tube is closed at the upper end and displaced in upward direction over a limited distance with simultaneous exertion of pressure on the self-hardening mass around the base of the pile shaft; and e.—the hollow tube is subsequently removed from the ground.

Such a method is known from DE-OS 21.20.691.

In this known method a smooth tube is used, driven into the ground by pile driving. After a prefabricated pile shaft has been placed into the tube and the annular space has been filled with a self-hardening mass, the tube is retracted from the ground with simultaneous exertion of pressure on the self-hardening mass by means of injection hoses, which self-hardening mass comes to lie around the pile shaft like a skin, at least in the bearing ground layer and also in the superjacent non-bearing ground layers. The thickness of this skin is substantially equal to the thickness of the annular space between pile shaft and tube. The adhesion of this skin of self-hardening mass to the bearing ground layer which surrounds this skin and which is compacted during pile driving, is not optimal and the presence of this skin in the non-bearing ground layer is undesired in view of the occurrence of negative adhesion at that location.

The object of the invention is to provide a method in which these drawbacks are overcome. To this end, the method according to the invention is characterized in that f.—the hollow tube is provided with a screw blade on the outside, and with an interior injection tube connectable to the pile base;

g.—which hollow tube is screwed into the ground with simultaneous supply of an optionally self-hardening mixture via the injection tube to form a "mixed-in-place" mixture around the hollow tube;

h.—subsequently, the injection tube is removed before the prefabricated pile shaft is placed into the hollow tube, whereupon the hollow space in the tube, after closure thereof, is pressurized internally at the upper end and, subsequently, the tube is displaced in upward direction over a limited distance, thereby forcing the self-hardening mixture into the annular space, cleared through the upward movement of the tube; whereafter i.—the hollow tube is subsequently rotated in the unscrewing direction, a pressure being exerted thereby in downward direction on the self-hardening mixture in the annular space by the mixed-in-place mixture, surrounding the hollow tube.

The method according to the invention provides the following advantages over the known method:

The diameter of the pile base is no longer related to the diameter of the tube, but is determined by the width of the screw blade provided on the exterior of the tube, which width, at the location of the lowermost tube portion, may be chosen to be greater or smaller than the width of the screw blade at the location of the remainder of the hollow tube.

The tube provided with a screw blade can function as a screw conveyor. During rotation of the tube in the unscrewing direction, the screw blade can exert a downward force on the skin of the mixed-in-place mixture present around the lower end of the pile shaft, so that this mixture is compacted and a good adhesion of this mixture to the surrounding ground layers and to the skin of self-hardening mass present around the pile base can be obtained. Also, a preload of the tip of the pile is realized, resulting in a very slight settlement behavior under load. Hence, the foundation pile thus formed has a greater bearing capacity than a foundation pile obtained with the use of the known method.

When the non-bearing ground layers are being drilled through, a non-self-hardening mixture such as bentonite may be supplied via the injection tube, so that in those ground layers the hollow tube is not surrounded by a self-hardening mixture. In this manner, negative adhesion, which has a adverse effect on the bearing capacity of the foundation pile, can be prevented.

It is observed that DE-PS 35.01.439 discloses a method for forming a foundation pile wherein a smooth tube, provided with a widened screw head at the lower end, is screwed into the ground, while, simultaneously, a self-hardening mixture is supplied via an injection tube and injected into the surrounding ground layer via the screw head. In this manner, a self-hardening—mixed-in-place—mixture is formed around the tube. However, the tube is left in the ground and is filled with concrete. Hence, the tube is part of the ultimate foundation pile.

Displacement of the tube in an upward direction over a limited distance can be realized in two manners, namely:

by rotating the tube in the unscrewing direction, or by retracting the tube from the ground, initially without rotation, followed by rotating it in the unscrewing direction. This second method is preferably used for forming a foundation pile for very high bearing capacities. In this method, the self-hardening mass present within the tube is allowed to flow out laterally into the space cleared by the upwardly drawn tube. When the tube is subsequently screwed further out of the ground, the wide skin of the self-hardening mass is pressurized in the manner of the first method.

The method according to the invention and the apparatus used therefor will be further explained with reference to the accompanying drawings. In these drawings.

Figure 1:
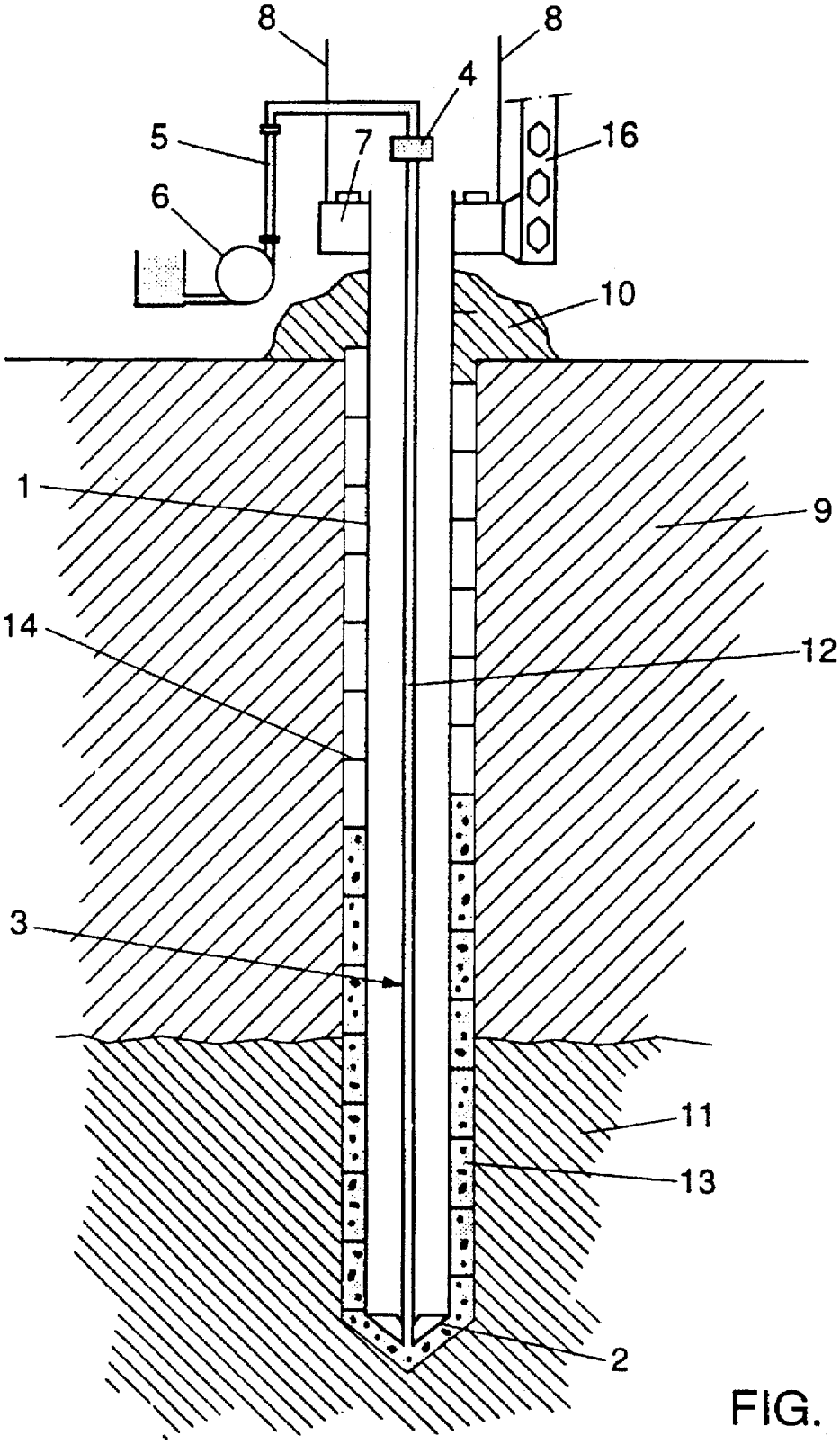
FIG. 1 shows a drill tube screwed into a bearing ground layer over some distance.

FIG. 1 shows the hollow drill tube 1, provided on the outside with a screw blade 14 to form a so-called auger tube. The tube 1 has been screwed through a non-bearing ground layer 9, over a specific length into a bearing ground layer 11, which normally consists of sand. At the lower end, the drill tube 1 is provided with a pile base 2, capable of axial movement relative to the tube 1, but coupled radially in such a mammer, that a moment exerted on the drill tube 1 is also transmitted to the pile base 2. The pile base 2 is provided with a series of screw blades as described in DE-PS 35.01439. Arranged within the hollow tube 1 is an injection tube 3, connected to the pile base 2 by means of a screw connection. Provided in the pile base 2 are openings which are in communication with the injection tube 3, allowing a liquid supplied to the pile base 2 via the injection tube to flow out of the openings at the lower end of the pile base 2. At the upper end, the injection tube 3 is provided with a coupling 4 of the swivel type, which coupling 4 is connected, via hoses 5, to a pump 6 for supplying a fluid to the injection tube 3. Normally, when non-bearing ground layers 9 are being drilled through, a non-self-hardening fluid, such as bentonite, is supplied via the injection tube 3, which flows out via the openings in the pile base 2 at the lower end and fills the space between the threads 14 of the hollow tube. Generally, when bearing ground layers are being drilled through, a self-hardening mixture 12, preferably a cement/water mixture, is supplied via the injection tube 3, which, as it flows out of the pile base 2, is mixed with the ground layer surrounding this pile base, to form a self-hardening sand/cement/water mixture 13, commonly referred to as a "mixed-in-place" mixture 13, surrounding the hollow tube 1 on the outside between the threads of the screw blade 14. The portion of the drill tube 1 projecting above the ground level is accommodated in a drilling case 7, to which pulling cables 8 are attached, which drilling case 7 is guidably coupled to a hanging post 16. The screw blade 14 of the drill tube 1 can also function as a screw conveyor, so that when the drill tube 1 is being screwed into the ground, a portion of the earth removed from the borehole forms a pile of earth 10 on the ground level. In the situation shown in FIG. 1, the pile base 2 has reached the desired level in the bearing ground layer 11 and the portion of the drill tube extending into that ground layer 11 is surrounded on the outside by the mixed-in-place-mixture 13. This mixture 13 is also located over some distance between the threads of the screw blade 14 in the non-bearing ground layer 9, while the upper portion of the tube between the screw blades 14 is surrounded by a skin of bentonite.

After the desired depth in the bearing ground layer 11 has been reached, the injection tube 3 is removed from the drill tube 1 and a prefabricated pile shaft 15, generally made of high-grade concrete, is placed into the drill tube. The pile shaft 15 comes to rest on the pile base 2 and located between the outer circumference of the pile shaft 15 and the inner wall of the drill tube 1 is an annular space **15*a*, which is filled with a self-hardening mass such as, for instance, grout, which is a sand/cement mixture to which a suitable aggregate is added. Subsequently, the drill tube 1 is closed at the upper end by means of a lid 18, which is generally sealingly connectable to the upper edge of the drill tube 1 by means of quick-action couplings. Extending through the lid 18 is an air-supply tube 18*a*, while a heavy hydraulic cylinder may be arranged between the upper end of the pile shaft 15 and the lid 18, the function of which will be described hereinafter. By supplying air under pressure via the air supply tube 18*a*, the interior of the drill tube 1 can be put under pressure, which pressure is exerted on the liquid provided in the annular space 15*a* (see arrow F1 in FIG. 2**).

Figure 2:
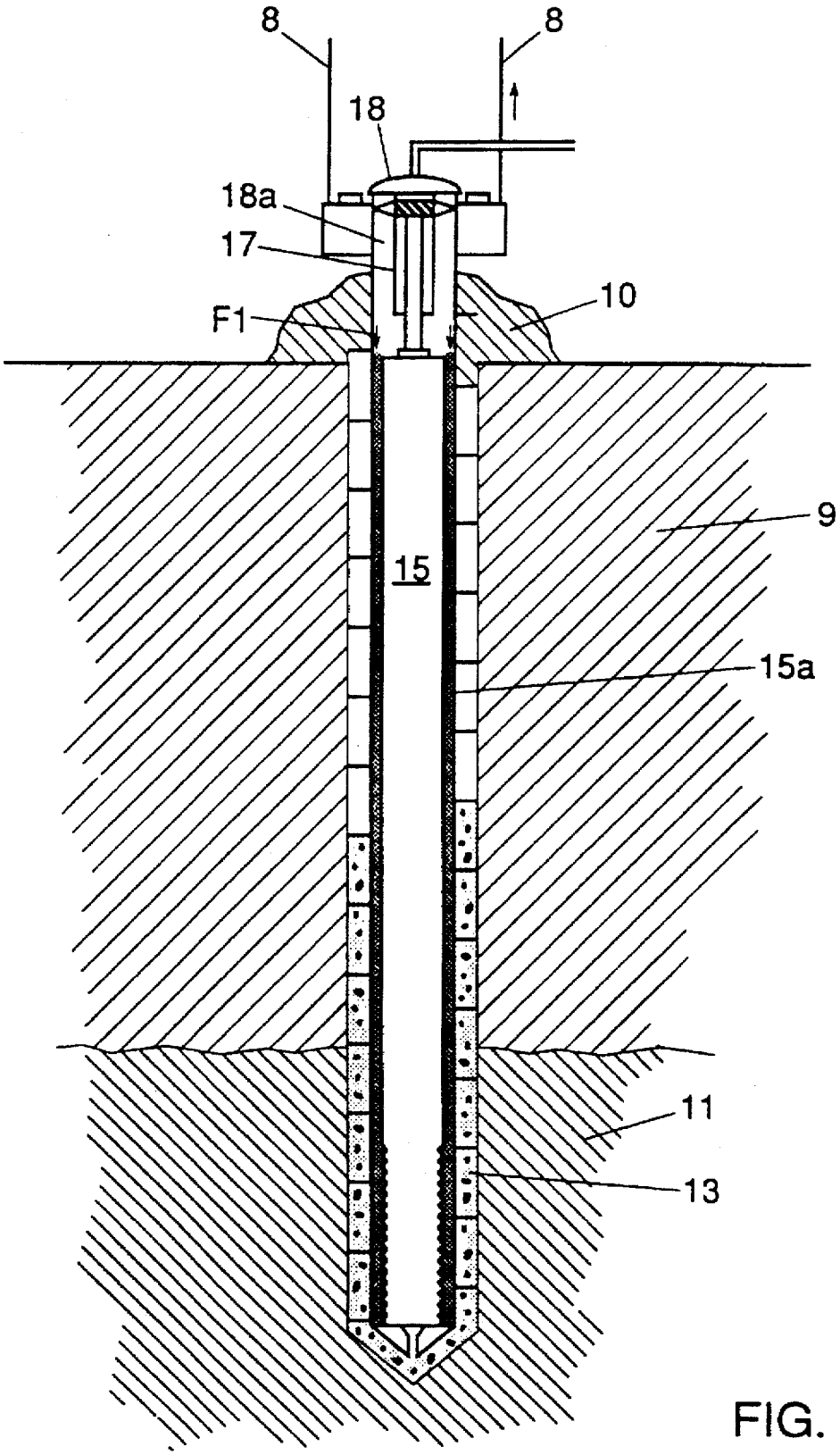
FIG. 2 shows the drill tube according to FIG. 1, provided with a prefabricated pile shaft.

After the situation shown in FIG. 2 has been reached, the drawing apparatus 8 is put under load, whereupon this drawing apparatus, together with the air pressure in the interior of the drill tube 1, will exert a pull-out force on the drill tube, which attempts to draw loose the drill tube, together with the substance received between the threads of the screw blade 14, from the pile base 2. The pulling force on the upper end of the drill tube 1 is being exerted until the lower edge of the drill tube 1 has reached a height of approximately 1 m below the top level of the bearing ground layer 11. During the upward movement of the drill tube 1, the mass of grout present in the annular space **15*a* is forced out by the air pressure prevailing inside the drill tube 1, whereby the annular space 19, cleared through the upward movement of the drill tube 1**, is filled.

If a foundation pile with a large bearing capacity is to be manufactured, the blade width of the screw blade 14 will be great and the corresponding pull-out force for drawing loose the drill tube 1 in upward direction will also be great. Under certain conditions the air pressure inside the drill tube and the leverage exerted on the drawing apparatus 8 may be insufficient for drawing the drill tube 1 loose from the pile base 2. In that case, a hydraulic cylinder 17 is used, capable of exerting a very great upward force on the drill tube 1 and which, together with the forces exerted on the drawing apparatus 8, is sufficient under all conditions for drawing the lower edge of the drill tube 1 loose from the pile base 2, which remains in place. The force exerted on the pile shaft 15 by the hydraulic cylinder 17 compacts the earth present below the pile base 2, which is thus preloaded and will subsequently exhibit a very slight settlement behavior when afterwards the foundation pile is put under load.

Figure 3:
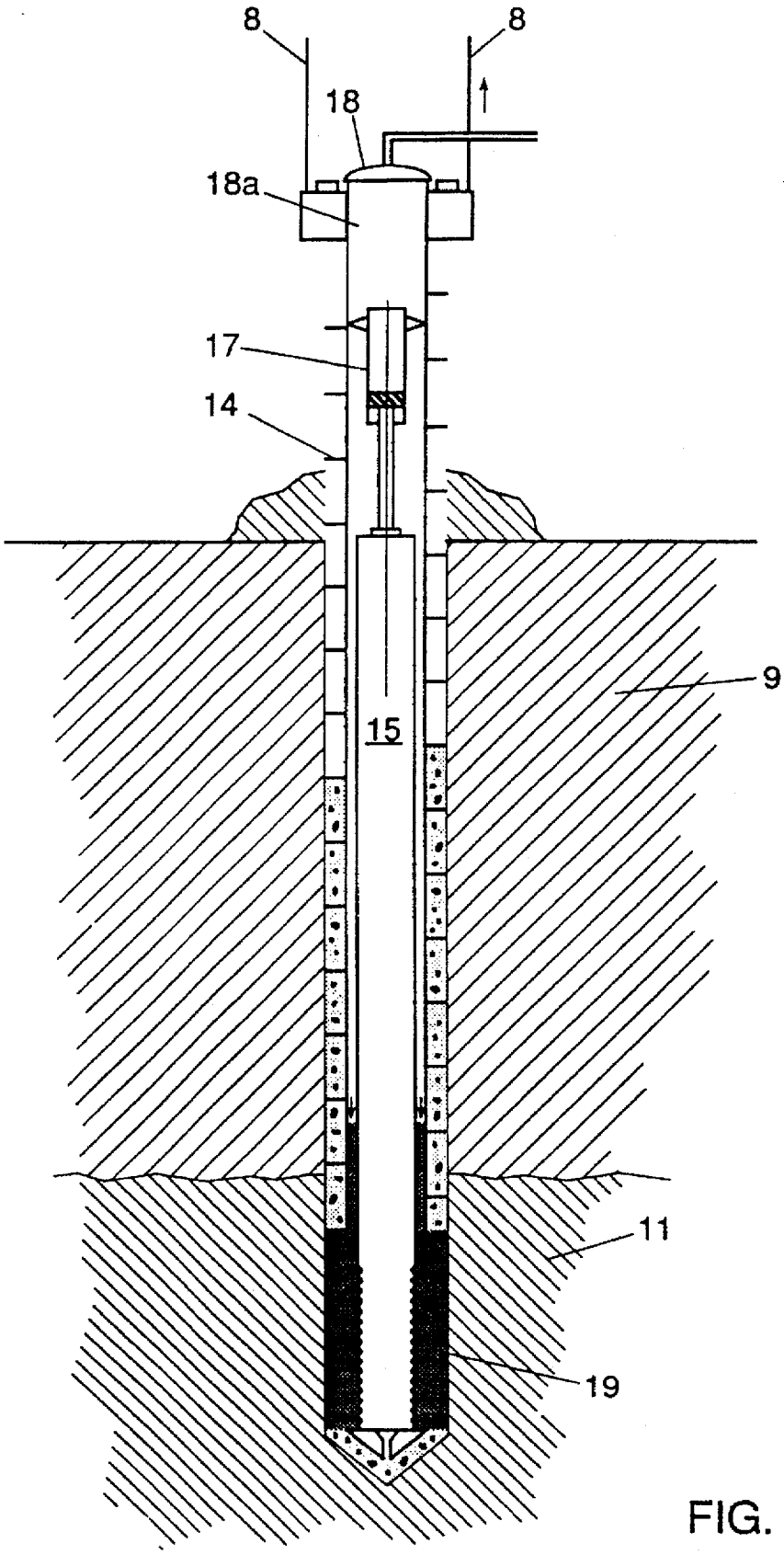
FIG. 3 shows the drill tube according to FIG. 2 after its being retracted from the ground over a limited distance.
Figure 4:
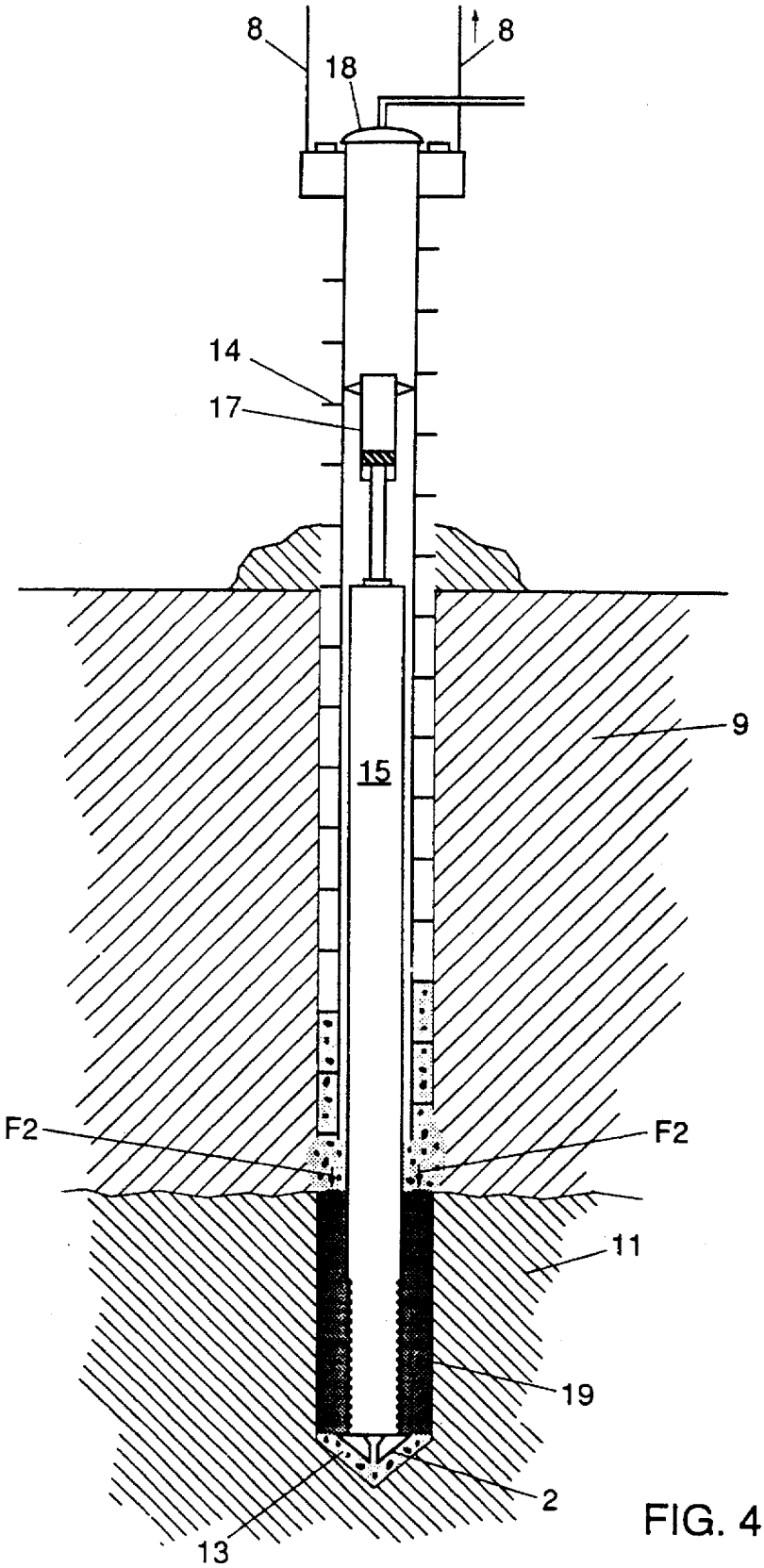
FIG. 4 shows the unscrewing of the drill tube while the pile base is being pressed down.
Figure 5:
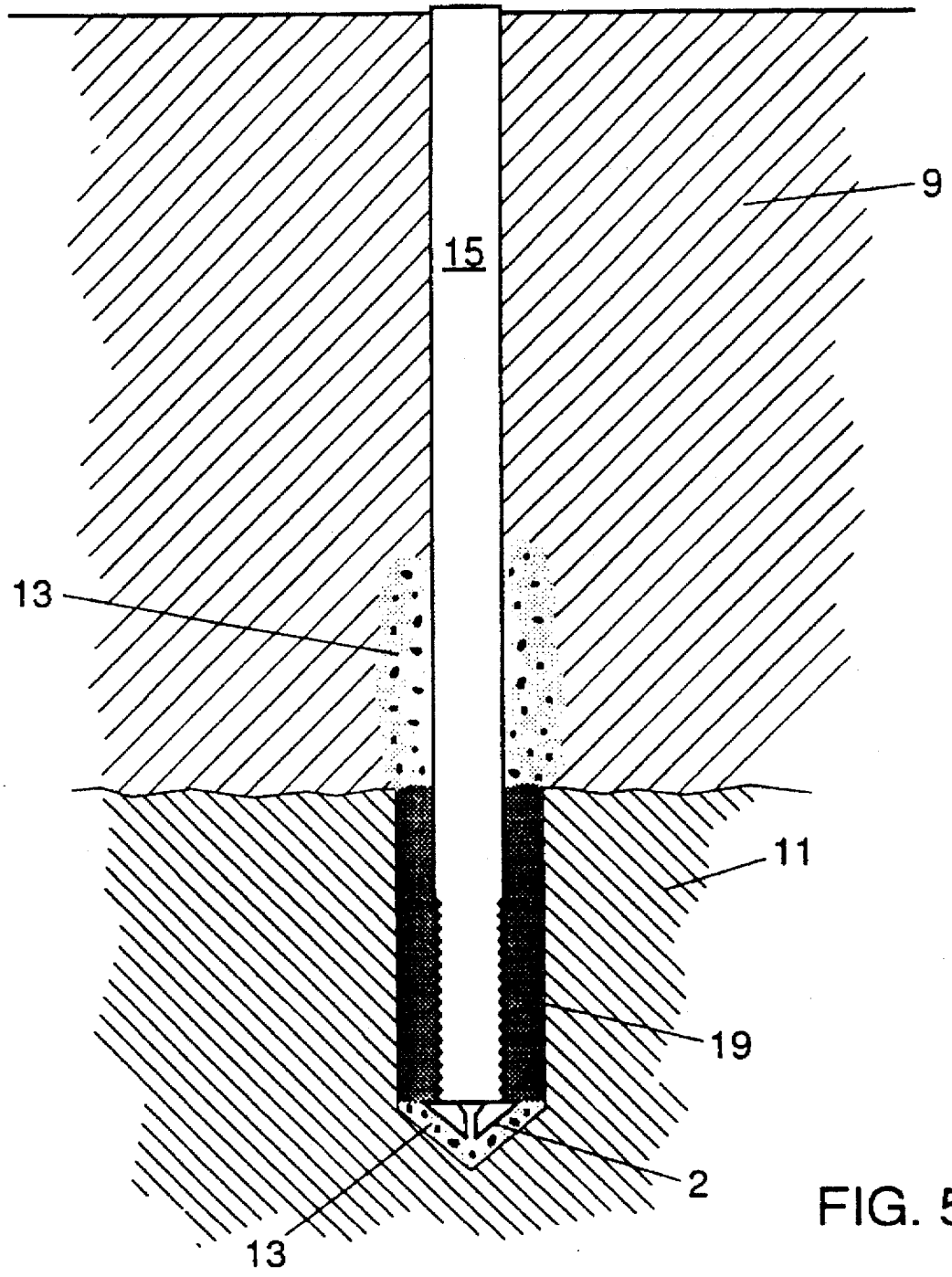
FIG. 5 shows the finished foundation pile.

After the drill tube 1 has reached the position shown in FIG. 3, the upward pulling forces exerted thereon are removed and the drill tube 1 is driven in the unscrewing direction (counter clockwise). In this connection, the screw blades 14, provided on the outside of the drill tube 1, function as a screw conveyor, the mixed-in-place mixture 13 present between the screw blades 14 being conveyed downwards and exerting a force F2 on the self-hardening mass in the annular space 19 (see FIG. 4). The mixed-in-place mixture 13 is partly pressed into the self-hardening mass in the space 19 and, further, partly into the surrounding ground layers. This ensures a good adhesion of the self-hardening mass in the annular space 19 to the surrounding ground layers. As soon as downward conveyance no longer takes place, the drill tube 1 unscrews itself from the borehole and the situation shown in FIG. 5 is obtained. Thus, the lower end of pile shaft 15 is surrounded by a widened pile base consisting of grout formed under high pressure. Above this grout ring, the pile shaft 15 is further surrounded by a mixed-in-place mixture 13 over some distance.

It will be understood that the thickness of the layer of grout in the space 19 is determined by the width of the screw blade 14, which width can be chosen to be greater or smaller, depending on the desired bearing capacity of the foundation pile to be provided in the ground.

Figure 6:
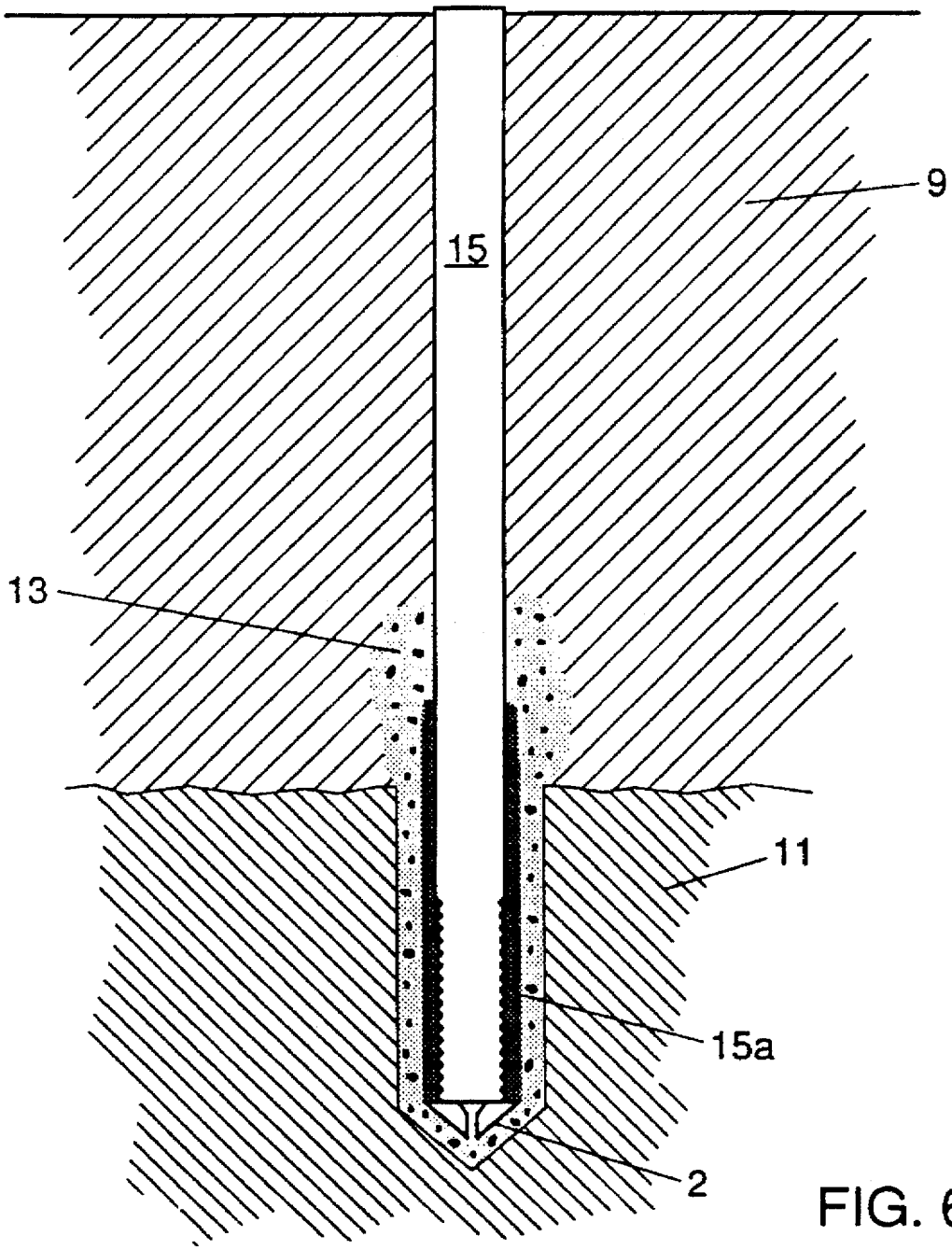
FIG. 6 shows a variant of the foundation pile according to FIG. 5, for lower bearing capacity.
Figure 7:
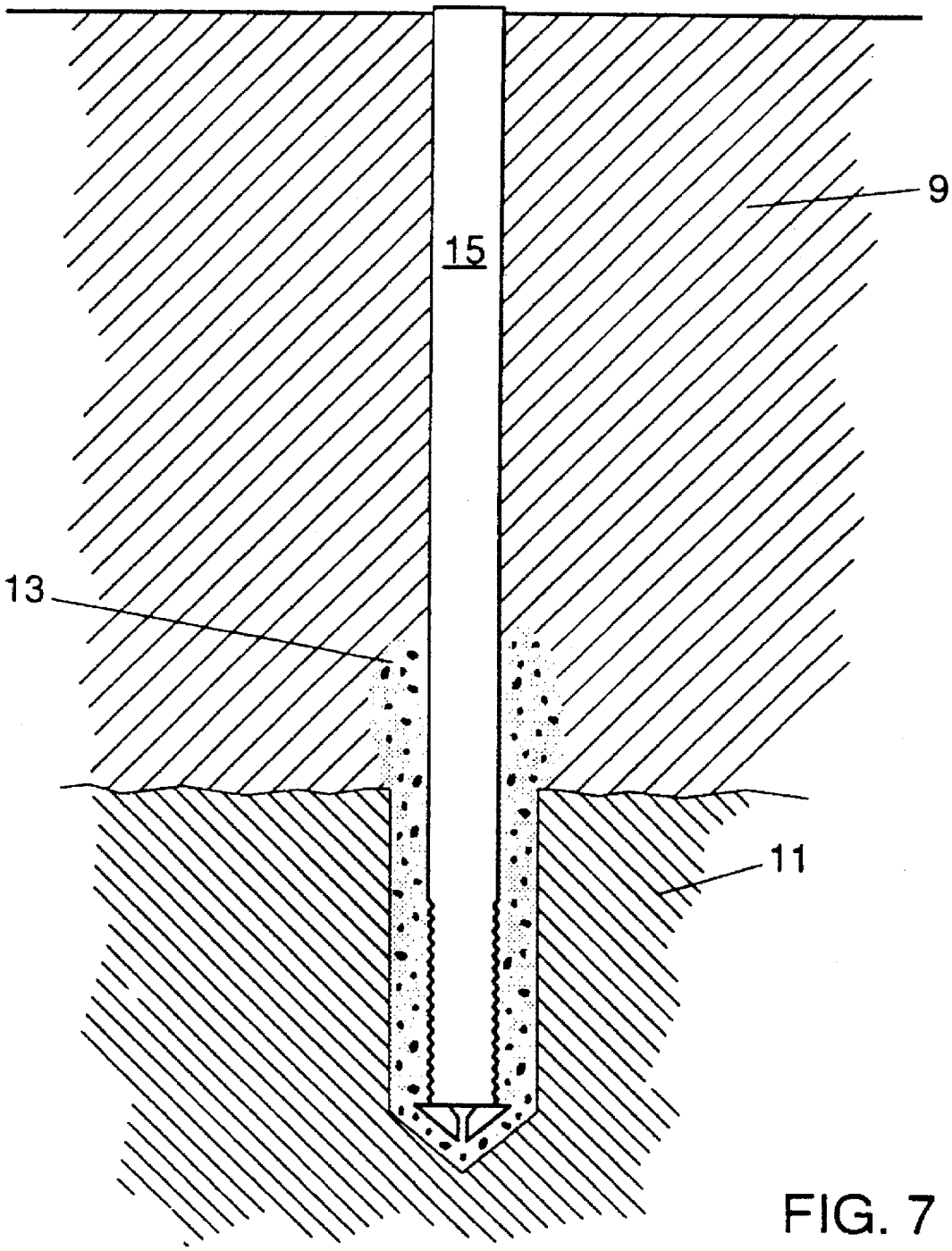
FIG. 7 shows a second variant according to FIG. 5 for even lower pile load.

The bearing capacity of the pile shaft 15 in the ground can be influenced not only by enlarging or reducing the width of the screw blade 14, but also in other manners. FIG. 6 shows a prefabricated pile shaft 15, surrounded at the lower end by a skin of grout, which in turn is surrounded by a mixed-in-place mixture 13. From the situation shown in FIG. 2, such a foundation pile can be obtained by removing the drill tube 1 from the bottom while rotating it counter clockwise, rather than drawing it loose over some distance. In this process, the mixed-in-place mixture between the screw blades compacts and the mass of grout present in the annular space **15*a* is not allowed to flow out outwards into the annular space 19, as shown in FIG. 3**.

I claim:

1. A method for forming a foundation pile in the ground comprising the steps of:

screwing a hollow tube into the ground until a desired length of a lower end of the tube extends into a bearing ground layer, wherein the hollow tube is closed at the lower end by a pile base and includes a screw blade formed on an outer surface thereof and a interior injection tube selectively extends from an upper end of the hollow tube through the pile base so that an outer surface of the hollow tube is in fluid communication with the interior injection tube;

injecting a mixed-in-place mixture to the pile base via the interior injection tube;

removing the interior injection tube from the hollow tube;

positioning a prefabricated pile shaft within the hollow tube so that a lower end of the pile shaft rests on the pile base and an annular space is left between an inner wall of the hollow tube and an outer surface of the pile shaft;

filling the annular space with a self-hardening mass;

closing an upper end of the hollow tube;

displacing the hollow tube a predetermined distance upward while maintaining the pile base and the pile shaft in place and simultaneously applying pressure to the self-hardening mass so that the self-hardening mass is forced into the space surrounding the pile shaft;

subsequently removing the hollow tube from the ground while exerting downward pressure on the mixed-in-place mixture.

2. A method according to claim 1, wherein the hollow tube is removed from the ground by rotating the hollow tube in an unscrewing direction.

3. A method according to claim 1, wherein, during the displacement of the hollow tube by the predetermined distance upward, the hollow tube is not rotated, and wherein, the hollow tube is subsequently removed from the ground by rotating the hollow tube in an unscrewing direction.

4. A method according to claim 3, further comprising the step of placing a hydraulic cylinder on top of a head of the prefabricated pile shaft to increase a pull-out force exerted on the hollow tube.

* * * * *

UNITED STATES PATENT AND TRADEMARK OFFICE

CERTIFICATE OF CORRECTION

PATENT NO. : 5,697,734

DATED : December 16, 1997

INVENTOR(S) : Alexander Julien VERSTRAETEN

It is certified that error appears in the above-identified patent and that said Letters Patent is hereby corrected as shown below:

Column 3, line 5, please change "mammer" to --manner--.

Column 3, line 5, please change "moment" to --movement--.

Column 5, line 8, please change "a" to --an--.

Signed and Sealed this

Twentieth Day of July, 1999

*Attest:*

*Attesting Officer*

Q. TODD DICKINSON

*Acting Commissioner of Patents and Trademarks*